US005808398A

United States Patent [19]

Stoffels et al.

[11] Patent Number: 5,808,398

[45] Date of Patent: Sep. 15, 1998

[54] METAL HALIDE LAMP HAVING SPECIFIC VOLUME PRESSURE RATIO

[75] Inventors: Jan A. J. Stoffels, Turnhout, Belgium; Willem J. Van Den Hoek, Eindhoven, Netherlands

[73] Assignee: U.S. Philips Corporation, New York, N.Y.

[21] Appl. No.: 804,511

[22] Filed: Feb. 24, 1997

[30] Foreign Application Priority Data

Feb. 28, 1996 [EP] European Pat. Off. ..... 96200522

[51] Int. Cl.[6] ..... H01J 61/30

[52] U.S. Cl. ..... 313/25; 313/568

[58] Field of Search ..... 313/25, 568, 570, 313/571, 572, 573, 637, 638, 639

[56] References Cited

U.S. PATENT DOCUMENTS 5,424,609 6/1995 Geven et al. ..... 313/623

FOREIGN PATENT DOCUMENTS 2137410 10/1984 United Kingdom .
9528732 10/1995 WIPO .

*Primary Examiner*—Sandra L. O'Shea
*Assistant Examiner*—Vip Patel
*Attorney, Agent, or Firm*—F. Brice Faller

[57] ABSTRACT

A metal halide lamp provided with an outer bulb having a volume $V_{bu}$ in which a discharge vessel with a volume $V_{ob}$ and having a ceramic wall is arranged, which vessel contains mercury, at least one halide, and also a rare gas having a filling pressure $P_{ob}$. The relation $P_{ob}*V_{ob}/V_{bu} \leqq 6$ mbar is satisfied.

4 Claims, 1 Drawing Sheet

METAL HALIDE LAMP HAVING SPECIFIC VOLUME PRESSURE RATIO

BACKGROUND OF THE INVENTION

The invention relates to a metal halide lamp provided with an outer bulb having a volume $V_{bu}$ in which a discharge vessel with a volume $V_{ob}$ and having a ceramic wall is arranged, which vessel comprises mercury, at least one halide, and also a rare gas having a filling pressure $P_{ob}$.

A lamp of the kind mentioned in the opening paragraph is known from WO 95/28732. The known lamp, which combines a high luminous efficacy with good color properties (among them general color rendering index $R_a \geqq 80$), is highly suitable for use as a light source for inter alia interior lighting, also because of its comparatively small dimensions.

The term "ceramic wall" in the present description and claims is understood to cover monocrystalline metal oxide (for example, sapphire), densely sintered polycrystalline metal oxide (for example, $Al_2O_3$, YAG) as well as polycrystalline densely sintered metal nitride (for example, AlN). With the term filling pressure is understood in the present specification the pressure at room temperature.

A possible effect occurring at the end of life of the known lamp is a strong direct current which gives rise to damage of the electric installation with which the lamp is operated. This forms a problem which the invention aims to solve.

SUMMARY OF INVENTION

According to the invention, a lamp of the kind mentioned in the opening paragraph is for this purpose characterized in that the filling pressure of the rare gas satisfies the relation $V_{ob}*P_{ob}/V_{bu} \leqq 6$ mbar, with $P_{ob}$ in mbar and $V_{ob}$ and $V_{bu}$ both in $mm^3$.

An important advantage of the lamp according to the invention is that the rare gas pressure in the outer bulb is strongly limited at least in the case of leakage of the discharge vessel. The risk of an arc discharge occurring in the outer bulb, and the accompanying occurrence of a strong direct current, is substantially counteracted thereby. Leaks of the discharge vessel are found to be the cause of the end of lamp life in many cases. The filling pressure of the rare gas is now preferably chosen to be such that the pressure of the rare gas in the case of a leaking discharge vessel is at most 6 mbar.

A limitation of the rare gas pressure such that it corresponds to a pressure in the outer bulb of at most 4 mbar is even found to render it impossible for an arc discharge to occur, indeed, only a glow discharge between live conductors is possible. The glow discharge is accompanied by a very weak current, which is a favorable property. This is in particular true in case of an a.c. voltage supply of at most 250 V or switch mode power supply providing a voltage level at most equal to the top voltage of said a.c. supply.

It is surprisingly found that although the satisfied relation results in a limited value for the rare gas filling pressure $P_{ob}$ the ignition properties of the lamp are not substantially influenced in comparison with the known lamp. The rare gas is added because of its ignition-promoting influence, which in general increases with an increasing filling pressure. A filling pressure of 40 mbar or less was found to be insufficient for effectively promoting the ignition.

The use of the measure in all embodiments of lamps according to the invention achieves that the identified problem is eliminated irrespective of the practical realization of the outer bulb, while it is also realised that lamps having mutually differing types of outer bulbs have a ignition behavior which is differing only slightly. For the purpose of a considerably simplification in manufacture it may be advantageous to limit the rare gas filling pressure $P_{ob}$ to at most 170 mbar.

The suitability of the lamp for interior lighting means that the rated lamp power is usually comparatively low, in practice preferably at most 150 W. Particularly suitable for practical applications are lamps with rated powers of inter alia 100 W, 70 W, 50 W, and 35 W, and possibly lower. The lamps may have a tubular shape or may be provided with reflectorized bulbs.

The high compactness of the discharge vessel renders the lamp highly suitable for use as a light source for making a light beam. A requirement for this is, however, that the outer bulb should have a similar compactness, which again results in the situation that current conductors to the discharge vessel are at a comparatively small distance from one another, especially in the case of a reflectorized bulb and a single-ended tubular bulb. A small distance between current conductors is generally conducive to the generation of a discharge.

BRIEF DESCRIPTION OF THE DRAWINGS

These and other aspects of the invention will be explained in more detail with reference to a drawing of an embodiment of a lamp according to the invention, in which FIG. 1 diagrammatically shows a lamp according to the invention.

DETAILED DESCRIPTION OF THE PREFERRED EMBODIMENTS

Figure 1:
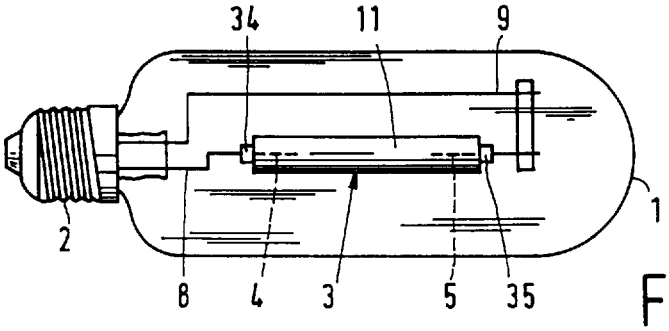
Figure 2:
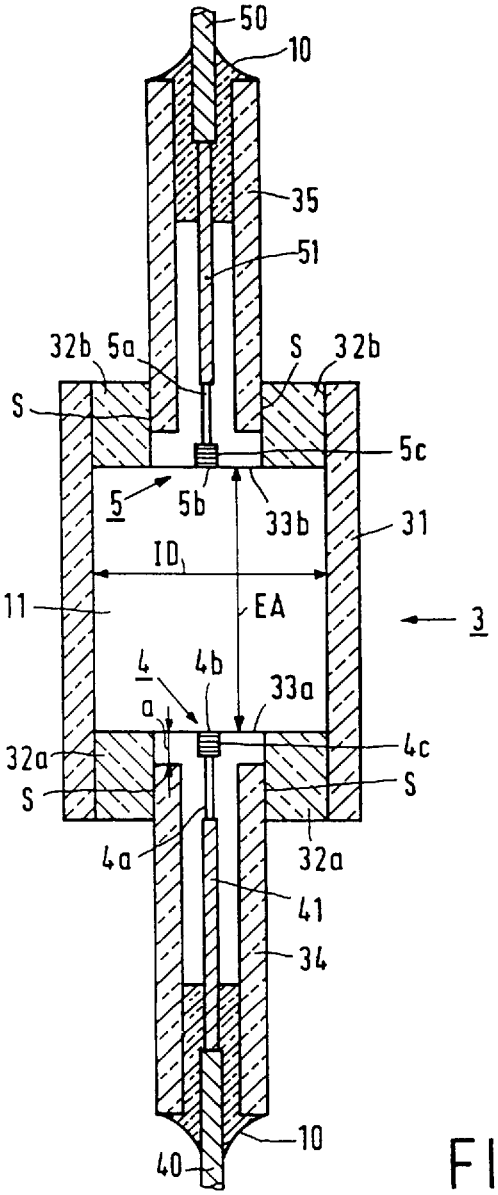
FIG. 2 shows the discharge vessel of the lamp of FIG. 1 in detail.

FIG. 1 shows a high-pressure discharge lamp provided with a discharge vessel 3 with a volume $V_{ob}$ and having a ceramic wall which encloses a discharge space 11. In a practical realization, the discharge vessel contains a filling which comprises Hg and at least one metal halide, as well as a rare gas having a filling pressure $P_{ob}$. The discharge vessel is closed at one side with a projecting ceramic plug 34, 35 which narrowly surrounds a current lead-through conductor (FIG. 2: 40, 41, 50, 51) to an electrode 4, 5 arranged in the discharge vessel and is connected thereto in a gas-tight manner by means of a melting-ceramic seal (FIG. 2: 10) at an end facing away from the discharge space. The discharge vessel is positioned in an outer bulb 1 having a volume $V_{bu}$ and which is provided with a lamp cap 2 at one end. A discharge extends between electrodes 4, 5 when the lamp is in the operational state. Electrode 4 is connected to a first electrical contact forming part of the lamp cap 2 via a current conductor 8. Electrode 5 is connected to a second electrical contact forming part of the lamp cap 2 via a current conductor 9. The discharge vessel, which is shown in more detail in FIG. 2 (not true to scale), has a ceramic wall and is formed from a cylindrical part with an internal diameter ID bounded on either side by end wall portions 32*a*, 32*b*, each end wall portion 32*a*, 32*b* defining an end surface 33*a*, 33*b* of the discharge space. The end wall portions each have an opening in which a projecting ceramic plug 34, 35 is fastened in a gas-tight manner in the end wall portion 32*a*, 32*b* by means of a sintered joint S. The projecting ceramic plugs 34, 35 each narrowly enclose a current lead-through conductor 40, 41, 50, 51 of a relevant electrode 4, 5 having a tip 4*b*, 5*b*. The current lead-through conductor is connected in a gas-tight manner to the projecting ceramic plug 34, 35 by means of a melting-ceramic seal 10 at the side facing away from the discharge space. The electrode tips 4*b*, 5*b* have an interspacing EA. The current lead-through conductors each comprise a halide-resistant portion 41, 51, for example in the form of a Mo—$Al_2O_3$ cermet 30 and a portion 40, 50 which is fastened to a relevant end plug 34, 35 in a gas-tight manner by means of the melting-ceramic seal 10. The melting-ceramic seal extends over a certain distance, for example approximately 1 mm, over the respective Mo-cermet 41, 51. The portions 41, 51 may be formed in a manner other than by a Mo—$Al_2O_3$ cermet. Other possible constructions are known from, for example, EP-0 587 238. A particularly suitable construction was found to be inter alia one comprising a halide-resistant coil provided around a similarly resistant pin. Mo is highly suitable as the halide-resistant material. The portions 40, 50 comprise a metal whose coefficient of expansion corresponds very well to that of the end plugs. Nb, for example, is a very suitable material. The portions 40, 50 are connected to the current conductors 8, 9 in a manner not shown in any detail. The lead-through construction described renders it possible to operate the lamp in any burning position.

Each of the electrodes 4, 5 consists of an electrode rod 4*a*, 5*a* provided with a coil 4*c*, 5*c* near the tip 4*b*, 5*b*. The electrode tips in the embodiment described lie substantially in the end surfaces 33*a*, 33*b* formed by the end wall portions.

The projecting ceramic plugs are provided so as to be recessed over a distance a relative to the end wall portions 32*a* and 32*b* and are fastened therein in a gas-tight manner by means of a sintered joint S. In an alternative embodiment of the lamp according to the invention, the projecting ceramic plugs 34, 35 are not recessed relative to the end wall portions 32*a* and 32*b*. In that case the electrode tips lie between the end surfaces 33*a*, 33*b* formed by the end wall portions.

In a practical realization of a lamp according to the invention as shown in the drawing, the rating of the lamp was 70 W, 240 V. The filling of the discharge vessel comprises 4.4 mg Hg and 8 mg NaI, TlI and $(Dy+Ho+Tm)I_3$ in a mass ratio of 65:10:25. The lamp in addition comprises Ar as an ignition gas with a filling pressure $P_{ob}$ of 160 mbar. The lamp was designed for a color temperature of 3000 K with color point coordinates (x, y; 437, 404) and a general color-rendering index Ra of more than 80. The discharge vessel is made of polycrystalline alumina, has an internal diameter ID of 6.85 mm and a distance between the electrode tips EA of 7 mm. The projecting plugs are sintered in the end wall portions at a distance a of 1 mm from the end surfaces formed by the end wall portions. The end wall portions each have a height of 3 mm, so that the sintered joint with the end plugs extends over a length of 2 mm. Such a length of the sintered joint is found to be sufficient in practice for realizing a sufficiently strong and gas-tight fastening between the end wall portion and the projecting plug, also in the case of large-scale mass production. The electrode tips lie in the end faces. The electrodes each comprise a W rod provided with a W coil at the tip.

Subsequently, a gas-tight melting-ceramic seal is formed between each projecting ceramic plug and the associated current supply conductor in a manner known per se.

The melting-ceramic seal 10 extends over a length of 3 to 3,5 mm of the end of the projecting plug facing away from the discharge space.

The discharge vessel has a volume $V_{ob}$ of 257 $mm^3$. The volume $V_{bu}$ of the outer bulb is 12.8 $cm^3$. The smallest interspacing between the current conductors 8 and 9 is 3 mm. The relation $P_{ob}*V_{ob}/V_{bu}$ has in this case a value of 3.2 thus satisfying the requirement $\leqq 6$.

In a lamp of the same rating, but provided with a reflectorized bulb, the smallest distance between the current conductors is 3 mm and the volume of the bulb $V_{bu}$ 6.23 $cm^3$. The rare gas filling pressure $P_{ob}$ in this practical case is 95 mbar and the relation is 3.9.

The volume of the discharge vessel of a practical lamp with a rating of 35 W, 240 V is 117 $mm^3$. The volume of the outer bulb is 5,71 $cm^3$ when a reflector bulb of the PAR 20 type is used. The smallest interspacing between the current conductors is 3 mm. The rare gas filling pressure $P_{ob}$ is chosen to be 200 mbar for this lamp resulting in a value of 4 for the relation $P_{ob}*V_{ob}/V_{bu}$.

The rare gas filling pressure in a further practical lamp is 60 mbar, here with a power rating of 150 W and with a tubular outer bulb of the 70 W lamp type. The discharge vessel of this lamp has a volume $V_{ob}$ of 930 $mm^3$ resulting in a value for the relation of 4.4.

We claim:

1. A metal halide lamp provided with an outer bulb having a volume $V_{bu}$ in which a discharge vessel with a volume $V_{ob}$ and having a ceramic wall is arranged, which vessel comprises mercury, at least one halide, and also a rare gas having a filling pressure $P_{ob}$, characterized in that the filling pressure of the rare gas satisfies the relation $V_{ob}*P_{ob}/V_{bu} \leqq 6$ mbar, with $P_{ob}$ in mbar and $V_{ob}$ and $V_{bu}$ both in $mm^3$.

2. A lamp as claimed in claim 1, characterized in that the filling pressure of the rare gas $P_{ob}$ is limited to the extent that it corresponds to a pressure in the outer bulb of at most 4 mbar.

3. A lamp as claimed in claim 2, characterized in that the lamp has a power rating of at most 150 W.

4. A lamp as claimed in claim 1, characterized in that the lamp has a power rating of at most 150 W.

* * * * *